US005284452A

United States Patent [19]

Corona

[11] Patent Number: 5,284,452

[45] Date of Patent: Feb. 8, 1994

[54] MOORING BUOY WITH HAWSER TENSION INDICATOR SYSTEM

[75] Inventor: Emilio N. Corona, Farmers Branch, Tex.

[73] Assignee: Atlantic Richfield Company, Los Angeles, Calif.

[21] Appl. No.: 4,826

[22] Filed: Jan. 15, 1993

[51] Int. Cl.[5] ..... B63B 45/00

[52] U.S. Cl. ..... 441/3; 114/230; 244/115

[58] Field of Search ..... 441/3-6, 441/11-20; 114/230, 144 B, 293; 116/19, 26, 56, 107, 202; 364/432; 244/115, 116

[56] References Cited

U.S. PATENT DOCUMENTS

| | | | |
|---|---|---|---|
| 3,947,907 | 4/1976 | Synodis | 441/3 |
| 4,205,379 | 5/1980 | Fox et al. | 364/432 |
| 4,755,947 | 7/1988 | Braschler et al. | 364/432 |
| 4,896,620 | 1/1990 | Jones | 441/16 |
| 4,912,464 | 3/1990 | Bachman | 114/293 |

*Primary Examiner*—Edwin L. Swinehart
*Attorney, Agent, or Firm*—Michael E. Martin

[57] ABSTRACT

An offshore mooring buoy for mooring a crude oil tanker and the like includes a hawser tension sensing member and a control circuit for generating indicator signals in response to predetermined mooring tension forces exerted on the buoy under varying sea conditions. A mast mounted on a mooring platform of the buoy includes a vertically-spaced array of colored indicator lamps which provide visual indication to the ship's crew of a range of acceptable, stand-by, and unacceptable mooring loads exerted on the buoy and the hawser. The circuit is also operable to energize a horn when a predetermined sustained mooring force is exerted on the buoy as a back-up signal or when weather conditions impair visual observation of the indicator lamps.

7 Claims, 1 Drawing Sheet

MOORING BUOY WITH HAWSER TENSION INDICATOR SYSTEM

BACKGROUND OF THE INVENTION

Field of the Invention

The present invention pertains to a mooring buoy having an on-board visual hawser tension indicator system viewable from the moored ship to indicate when an excessive hawser mooring load is being experienced.

Background

Ships moored offshore are, of course, subject to varying sea conditions and the mooring tension on the buoy or other mooring structure should be monitored for excessive tension or load on the mooring hawser to prevent unwanted parting of the hawser, dragging of the mooring buoy or damage to the mooring structure. One type of offshore mooring buoy for which it is particularly critical to monitor mooring tension when a ship is moored thereto is that which is adapted for offshore loading of oil tankers and the like. Not only should the mooring load be monitored to prevent unwanted parting of the mooring hawser but unwanted parting of oil-loading conduits extending between the buoy and the ship must also be prevented. Moreover, it is important to not exceed a predetermined mooring tension to prevent unwanted dragging of the buoy from its anchorage and parting of the oil-loading conduit leading from the shore based source of oil and the buoy itself.

Proposals have been made to provide a system for monitoring the tension in a mooring hawser for offshore oil-loading buoys wherein a radio link between the buoy and the ship is provided to transmit information to a shipboard receiver indicating the tension on the mooring hawser or other mooring structure. This type of system, of course, requires placement and retrieval of the receiver unit aboard ship with the arrival and departure of each vessel. Many offshore loading buoys are particularly busy in that one oil carrier is brought in for mooring to the buoy as soon as a loaded ship departs.

It has been considered desirable to have a self-contained visual and audible mooring load indicator system for an offshore mooring buoy which is reliable, uncomplicated, requires low maintenance and does not require placement of any instrumentation or telemetry devices on board the ship itself. It is to this end that the present invention has been developed with a view to providing a unique ship mooring load indicator system and arrangement for an offshore mooring buoy which meets the desiderata mentioned above as well as providing other features which will be appreciated by those skilled in the art.

SUMMARY OF THE INVENTION

The present invention provides a unique mooring tension indicator system particularly adapted for an offshore mooring buoy and similar mooring structures which provides visible and audible indication of the tension in a ship mooring hawser or the like.

In accordance with one important aspect of the present invention, a hawser tension load indicator system is provided for a mooring buoy which is characterized by an upstanding mast with an array of indicator lamps mounted thereon which are constantly visible from on board a ship which is moored to the buoy.

In accordance with another aspect of the present invention, there is provided a ship mooring tension indicator system for an offshore mooring buoy which provides both visual and audible signals to the ship to indicate a safe mooring tension condition, a stand-by condition and a tension load condition which requires corrective action by the ship's crew.

The system is controlled by a circuit which may include a signal processing unit which monitors changes in the mooring tension with respect to time to discriminate between infrequent peak loads on the buoy and more frequent or steady-state loads which require attention or corrective action.

The system of the present invention is uncomplicated, reliable, may be easily adapted to existing, as well as newly-installed, offshore mooring buoys and similar mooring structures and include the unique features mentioned hereinabove as well as others which will be appreciated by those skilled in the art upon reading the detailed description which follows in conjunction with the drawing.

DESCRIPTION OF A PREFERRED EMBODIMENT

Figure 1:
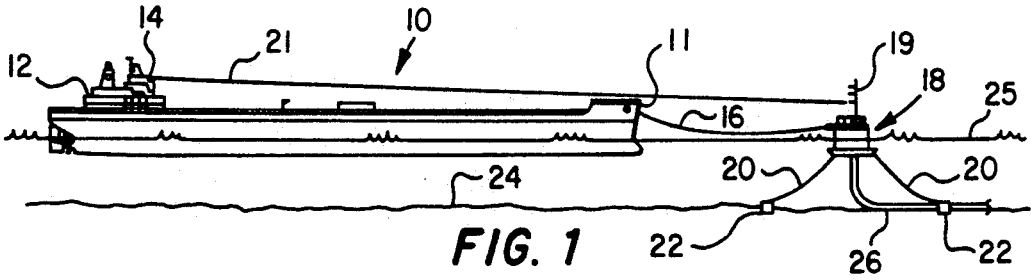
FIG. 1 is a view showing a marine oil tanker moored to an offshore oil transfer and mooring buoy including the mooring tension indicator system of the present invention.

In the description which follows, like parts are marked throughout the specification and drawing with the same reference numerals, respectively. The drawing figures are not necessarily to scale and certain elements are shown in schematic or generalized form in the interest of clarity and conciseness.

Referring to FIG. 1, there is shown a ship 10 comprising a bulk oil carrier or tanker of a type having a deck house 12 disposed aft and at the top of which is located a navigation bridge 14. The ship 10 is shown moored at its bow 11 in a conventional manner by a single hawser 16 connected to a mooring buoy, generally designated by the numeral 18. The exemplary buoy 18 is of the catenary anchor leg type and is moored by a plurality, usually three or four, catenary anchor chains 20, two shown in FIG. 1, to suitable anchors 22 disposed on the sea bed 24. The buoy 18 is of a type which also provides for loading or unloading of liquids with respect to the tanker 10, which liquids are conducted to or from the buoy by way of a conduit 26 disposed on the sea bed 24 and connected to the buoy in a known manner. A floating conduit, not shown in FIG. 1, is also connected to the buoy 18 above the sea surface 25 and may float on the sea surface and be connected to the ship 10 for transfer of liquids such as crude or refined petroleum to or from the ship.

The buoy 18 is of a type which permits the ship 10 to change its bearing or pivot about the buoy anchorage so that it is headed into the wind or undergoes so-called "weather-vaning" in a known manner. The buoy 18 is also modified to provide a unique indicator system for indicating to the ship's crew predetermined plural ranges of mooring tension in the hawser 16 so as to apprise the crew of a condition wherein the hawser may be subject to a parting load or a load which will drag the buoy 18 from its predetermined anchorage. In particular, the indicator system of the present invention comprises a plurality of visual indicators or lamps mounted vertically spaced apart on an upstanding mast 19 mounted on the buoy 18 so as to provide visual signals between the buoy 18 and the navigation bridge 14 generally along a line of sight 21.

Figure 2:
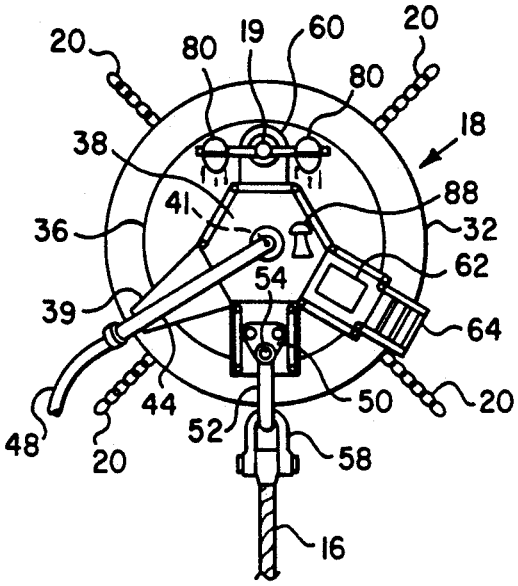
FIG. 2 is a plan view of the buoy shown in FIG. 1.
Figure 3:
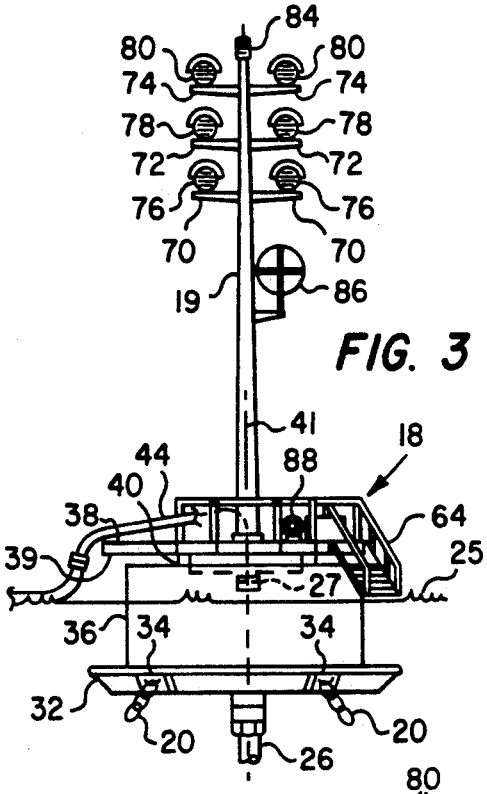
FIG. 3 is an elevation of the buoy shown in FIGS. 1 and 2.

Referring now to FIGS. 2 and 3, the buoy 18 includes a somewhat mushroom-shaped antiroll base 32 having suitable attachment points 34, FIG. 3, for attaching the anchor chains 20 thereto. A generally cylindrical buoyancy can member 36 extends upwardly from the base 32 and provides suitable support for a mooring platform 38 which is mounted on the buoyancy member 36 on suitable bearing means 40 for substantially free pivotal movement of the platform about a central vertical axis 41 with respect to the buoyancy member 36.

The mooring platform 38 includes a generally horizontally projecting arm 39 for supporting an oil transfer conduit 44 which is suitably connected to the conduit 26 by a swivel coupling 27, FIG. 3, disposed on the buoyancy member 36. The conduit 44 is suitably connected to a transfer hose 48, FIG. 2, which may be adapted to float on the sea surface 25 and be suitably connected to the ship 10 in a conventional manner. The platform 38 also supports and is secured to a mooring plate member 50, FIG. 2, which is connected to a mooring clevis 52 by a force sensing pin 54, also shown in FIG. 2, which may be suitably instrumented, as will be described hereinbelow, to indicate the tension in the hawser 16 and exerted on the buoy 18. A second clevis 58 is suitably connected to the hawser 16 in a conventional manner as illustrated in FIG. 2. The portion of the platform 38 which supports the plate 50 is deleted in FIG. 3 in the interest of clarity. The particular connection between the hawser 16 and the mooring platform 38 illustrated is exemplary and various modifications may be made to the particular structure illustrated to include other types of tension-sensing devices including hydraulic pressure transmitters, piezoelectric sensors and similar transducers for indicating tensile loads in cables and other structural members. Moreover, the hawser 16 may be replaced by suitable mooring structures interconnecting the ship 10 with the clevis 52, such as a rigid boom or the like, not shown.

Referring further to FIGS. 2 and 3, the platform 38 also includes a support member 60 which supports the mast 19 spaced from and opposed to the portion of the platform 38 supporting the plate 50. Still further, the platform 38 includes a portion supporting a watertight enclosure 62 which is adapted to house certain components of a control system for measuring the tensile load on the hawser 16 and including certain elements of the load indicating system of the present invention. An access ladder 64 is shown supported on the mooring platform 38 to provide access thereto for inspection and repair of the various elements disposed on the buoy 18.

Referring further to FIG. 3, the mast 19 includes plural opposed and vertically-spaced support arms 70, 72 and 74 which support three pairs of indicator lamps 76, 78 and 80, respectively. Other color combinations may be used. The lamps 76, 78 and 80 project colored light beams in a direction generally aligned with the hawser 16 and the line of sight 21 so that these lamps may be viewed from the bridge 14 at all times. The lamps 80, 78 and 76 preferably emit red, amber and green visual signals, when energized or lit, respectively. The mast 19 must, necessarily, be tall enough and the lamps 76, 78 and 80 mounted high enough thereon to provide the line of sight 21 between the array of lamps and the navigation bridge 14 of the ship 10. A suitable height for the mast 19 is in a range of about 20 to 30 feet above the platform 38, assuming that the platform itself normally rides about six to ten feet above the sea surface 25. The mast 19 may also support certain navigation aids such as an omni-directional navigation light 84 mounted on top of the mast and a radar reflector 86, as illustrated.

The mooring tension indicator system of the present invention may also include an audible signal generator or horn 88 which may be mounted on the platform 38, as illustrated, or on the mast 19. Since the location of the horn 88 is not required to be on the mast for reception of its signal by the ship's crew, disposal on the platform 38 may facilitate maintenance thereof, if required. Thanks to the location of the mast 19 on the pivotable mooring platform 38, the indicator lamps 76, 78 and 80 are always positioned such as to be pointed toward the bridge 14 to project their beams along line of sight 21. The lamps 76, 78 and 80 may be provided in groups of more than two and spaced horizontally apart for good visual perception.

Figure 4:
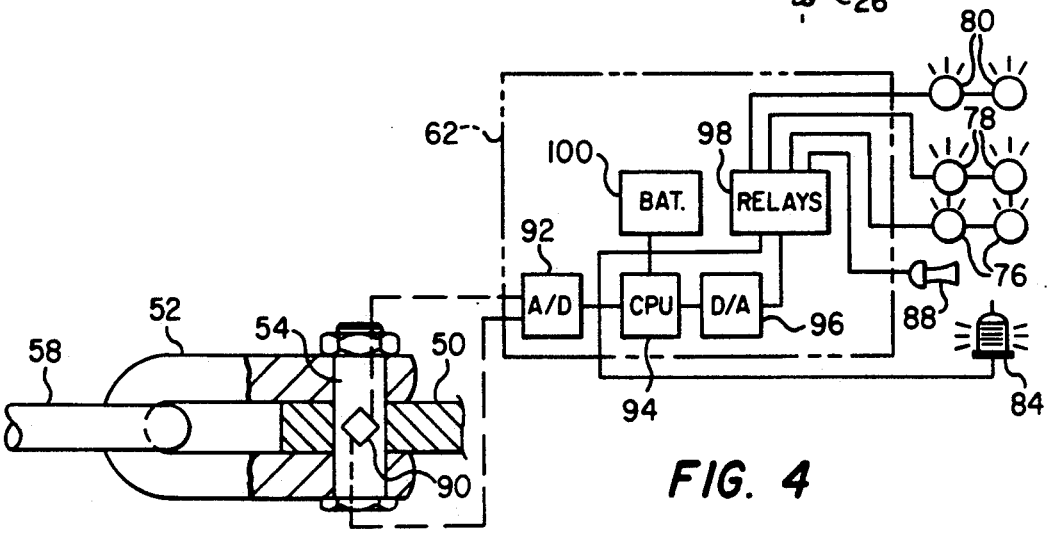
FIG. 4 is a diagram showing general features of a control circuit for controlling the visual and audible signals to indicate predetermined ranges of tension in the ship mooring hawser.

Referring now to FIG. 4, there is illustrated a schematic diagram of the major components of the hawser tension or mooring load indicator system including the mooring pin 54 which is adapted to include a strain gage circuit 90 suitably disposed on the pin and operable to measure stresses in the pin which are related to the tension in the mooring hawser 16 and the consequent force exerted on the buoy 18. The strain gage circuit 90 is suitably connected to a circuit disposed in the enclosure 62 and which typically includes an analog to digital converter circuit 92 connected to a digital computer, such as a microprocessor designated as CPU 94. The CPU 94 is also suitably connected to a digital to analog converter circuit 96 which is operable to operate the lamps or visual indicators 76, 78 and 80 and the audio signal indicator or horn 88 through a suitable relay circuit 98.

Electrical power for the control system disposed in the enclosure 62 as well as the lamps 76, 78 and 80, the navigation light 84 and the horn 88 is preferably provided by suitable batteries, generally designated by the numeral 100, also disposed in the enclosure 62. The batteries may be of a rechargeable type which may be connected to suitable charging means, not shown, or the batteries may be of a type which may be replaced periodically by maintenance personnel as part of a test and maintenance program for testing the operability of the mooring hawser load indicating system.

The lamps 76, 78 and 80 may be configured to project their beams in a relatively narrow field of view and directed toward the mooring pin 54 and, of course, along the line of sight 21 toward a typical viewing point from aboard the ship 10, such as the navigation bridge 14. In this way, the beams of the lamps 76, 78 and 80 will not normally be viewed from other directions and will not normally be mistaken for navigation lights. In any case the navigation light 84 is mounted for viewing all around the horizon in accordance with international navigation regulations.

The digital computer, microprocessor or CPU 94 may be programmed to read signals from the force sensing mooring pin 54 on a substantially continuous basis and to provide output signals to the visual and audible indicators only when predetermined forces exerted on the mooring pin 54 exceed a predetermined amount over a predetermined period of time. For example, if instantaneous forces caused by infrequent or rogue waves or wind gusts, for example, momentarily raise the tension in the hawser 16, the CPU 94 may be programmed to not relay that force signal to the circuits which control the indicators. However, when sustained or periodic forces of a predetermined frequency or average force level occur, certain signalling criteria may be reached.

By way of example, if the tension in the hawser 16 does not, on a sustained or predetermined average frequency basis, exceed 30% of a predetermined maximum rated force exerted on the buoy which will cause the buoy to leave its anchorage, the green indicator lamps 76 will be energized to provide a signal that a range of 0% to 30% of the predetermined or rated mooring tension of the buoy and/or the hawser 16 is being experienced. When a steady-state or predetermined peak force as a function of time exists on the hawser 16, say in a range of 30% to 80% of the peak rated force, the amber lamp 78 will be energized and the green lamp 76 de-energized. Finally, for example, if the hawser tension reaches a value of 80% or more of the rated maximum tension, the red lamps 80 will be energized and the amber lamps 78 de-energized.

The audible signal generator 88 may be energized to provide suitable signals when, for example, weather conditions hinder visual observation of the lamps 76, 78 and 80 and also when the hawser tension 16 reaches a predetermined value, say, for example the value which will energize the red indicators 80. The audible signal generator or horn 88 may also comprise the standard navigation aid or fog horn for the buoy 18. In other words, the horn 88 may function as the fog horn and may be energized to modify its signal under conditions wherein the hawser tension exceeds a predetermined amount either, for example, in the amber indicator range or the red indicator range. Those skilled in the art will recognize that the CPU 94 may be programmed in accordance with different predetermined tension ranges sensed by the mooring pin 54 and the above-mentioned force ranges and signal-generating scenarios are exemplary. Moreover, the mooring bolt 54 comprising the tension sensing element for the mooring hawser 16 may comprise other types of load sensing elements such as hydraulic pressure transducers and other types of force transducers which may be suitably interconnected between the buoy and the hawser 16. The buoy 18 may be constructed using conventional engineering practices for offshore mooring buoys and the like and the hawser tension indicators 76, 78 and 80 may be constructed in accordance with known engineering practice for high or medium intensity lamps for marine applications.

Although a preferred embodiment of the present invention has been described in detail herein, those skilled in the art will recognize that various substitutions and modifications may be made to the mooring buoy 18 and the hawser tension indicator system without departing from the scope and spirit of the invention as recited in the appended claims.

What is claimed is:

1. An offshore mooring buoy for mooring a ship such as a bulk liquid carrier, said buoy comprising:

a buoyancy member operable to be anchored in a predetermined position for mooring said ship, a mooring platform supported on said buoyancy member and operable to pivot about an axis with respect to said buoyancy member to change the bearing of said ship with respect to said buoy when said ship is moored thereto;

means on said mooring platform for connecting a mooring hawser between said ship and said buoy, said means including a hawser tension sensing member;

a control circuit operably connected to said tension sensing member for generating signals related to the mooring tension on said buoy exerted by said ship; and an array of visual signal indicators mounted on said buoy and positioned to project visual mooring force indicating signals toward said ship.

2. The buoy set forth in claim 1 wherein:

said visual indicators are disposed spaced apart on a mast extending generally vertically from and supported on said mooring platform.

3. The buoy set forth in claim 2 wherein:

said mast is disposed opposite said tension sensing member with respect to said axis.

4. In an offshore mooring buoy for mooring a ship, a mooring platform on said buoy which is pivotable about an axis to allow said ship to remain moored and to vary its bearing with respect to said buoy, a mooring force sensing member connected to said platform to interconnect said buoy with said ship, means for generating signals related to the mooring force sensed by said force sensing member and visual indicator means supported on said platform and pointed toward said ship and operable to project visual mooring force signals toward said ship regardless of the bearing of said ship with respect to said buoy to indicate a predetermined range of mooring forces exerted by said ship on said buoy.

5. In an offshore mooring buoy for mooring a ship, a mooring force sensing member interconnected between said buoy and said ship, means for generating signals related to the mooring force sensed by said force sensing member and visual indicator means comprising an array of lamps disposed on said buoy and oriented to project selected ones of a plurality of visual signals toward said ship indicating a predetermined range of mooring forces exerted by said ship on said buoy.

6. The buoy set forth in claim 5 wherein:

said lamps are disposed on a generally vertical mast supported on said buoy.

7. The buoy set forth in claim 6 wherein:

said lamps are provided in vertically spaced groups of lamps.

* * * * *